US007272462B2

(12) United States Patent
Smedley et al.

(10) Patent No.: US 7,272,462 B2
(45) Date of Patent: Sep. 18, 2007

(54) PROCESS FOR PRODUCING A KNITTED FABRIC

(75) Inventors: John Smedley, Nottinghamshire (GB); Andrew Ratcliffe, Nottinghamshire (GB)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 10/548,218

(22) PCT Filed: Mar. 3, 2004

(86) PCT No.: PCT/GB2004/000863

§ 371 (c)(1),
(2), (4) Date: Nov. 20, 2006

(87) PCT Pub. No.: WO2004/079073

PCT Pub. Date: Sep. 16, 2004

(65) Prior Publication Data

US 2007/0156276 A1 Jul. 5, 2007

(30) Foreign Application Priority Data

Mar. 7, 2003 (GB) ..... 0305183.6

(51) Int. Cl.
*G06F 19/00* (2006.01)

(52) U.S. Cl. ..... 700/141

(58) Field of Classification Search ..... 700/130, 700/131, 133, 135, 141
See application file for complete search history.

(56) References Cited

U.S. PATENT DOCUMENTS

| | | | | |
|---|---|---|---|---|
| 5,557,527 | A * | 9/1996 | Kotaki et al. | 700/131 |
| 5,719,777 | A * | 2/1998 | Kotaki | 700/131 |
| 6,611,730 | B1 * | 8/2003 | Stoll et al. | 700/131 |
| 6,880,367 | B2 * | 4/2005 | Suzuki | 66/232 |
| 6,895,787 | B2 * | 5/2005 | Maeiwa | 66/232 |
| 2004/0065380 | A1 * | 4/2004 | Speich | 139/383 R |

FOREIGN PATENT DOCUMENTS

| | | |
|---|---|---|
| DE | 101 59 971 | 6/2002 |
| EP | 0 853 153 | 7/1998 |
| WO | WO 02/066720 | 8/2002 |

* cited by examiner

*Primary Examiner*—Danny Worrell

(57) ABSTRACT

A method for creating pattern instructions for an electronic patterning control of a knitting machine to enable the knitting machine to knit fabric having a desired pictorial image as part of the knitted structure, the pictorial image being created by a series of consecutive courses each having knitted stitches formed of a first yarn having a first visual characteristic interspersed with knitted stitches formed of a second yarn having a second visual characteristic, adjacent knitted stitches of the second yarn that are separated by one or more knitted stitches of the first yarn being connected by a float loop spanning said one or more knitted stitches of the first yarn.

13 Claims, 12 Drawing Sheets

PROCESS FOR PRODUCING A KNITTED FABRIC

BACKGROUND OF THE INVENTION

1. Field of the Invention

The present invention relates to a process for producing a knitted fabric having on its surface a pictorial image derived from an electronically stored digital image.

The invention also relates to a knitted fabric having such a pictorial image on its surface.

2. Description of Related Art

The electronically stored image may be a photograph depicting any desired scene or image or may be a graphical design.

Conventionally it is known to provide pictorial photographic images on the surface of knitted fabrics by printing techniques such as subliminal printing.

However, producing images on the surface of a fabric in the form of a print is undesirable as it involves an additional manufacturing process. Also, since the print is a surface treatment, there is a danger that the quality of the print will deteriorate with use and ageing of the fabric. This is particularly so where the fabric is used in a garment.

BRIEF SUMMARY OF THE INVENTION

A general aim of the present invention is to recreate an electronically stored digital image on the surface of the fabric by a technique which does not require an additional manufacturing process and which provides an image which is less likely to deteriorate with ageing and use of the fabric.

This is achieved in accordance with a preferred embodiment of the present invention by patterning control of the knitting machine so that the pictorial image is produced during creation of the fabric and so forms part of the fabric structure.

A benefit of using a printing process to produce the pictorial image is that it is a flexible process in the sense that the reproduction process is not restricted by the complexity of the image, i.e. simple or highly complex photographic images can be printed onto the fabric surface with the same ease without regard to the complexity of the image content. By contrast, the image content is relevant to the reproduction process if the image is being recreated by a fabric structure, i.e. the more complex the image, the more complex the knitted pattern for reproducing the image. In the past, this has been a limiting factor in the production of pictorial images on a fabric using patterning control.

Another general aim of the present invention is to provide a process for converting, in a relatively easy manner and irrespective of image complexity, an electronically stored image into a set of electronic pattern control instructions which can be used to control a knitting machine to produce a pictorial image on the fabric to a resolution which is acceptable for reproducing the electronically stored image.

BRIEF DESCRIPTION OF THE SEVERAL VIEWS OF THE DRAWINGS

Various aspects of the present invention are hereinafter described with reference to the accompanying drawings, in which:—

DETAILED DESCRIPTION OF THE INVENTION

Figure 1:
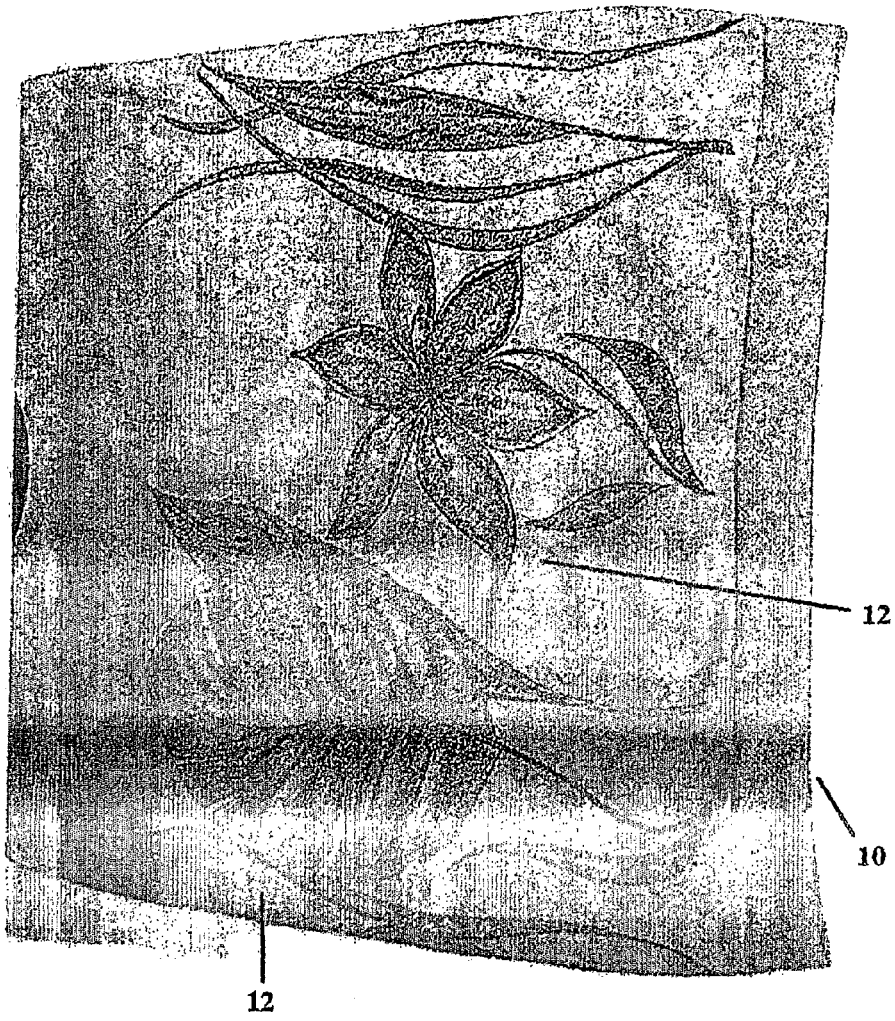
FIG. 1 is a photograph showing a portion of fabric knitted in accordance with a preferred embodiment of the invention.

In FIG. 1 there is shown a piece of tubular knitted fabric 10 having a floral pictorial image 12 on one face.

In the illustrated example (see in particular FIG. 2), the pictorial image 12 is a knitted structure using two yarns 16, 18 which produce a visually contrasting appearance; for example the yarns may be of contrasting colour or the same colour but of a different tone or shade.

Figure 2:
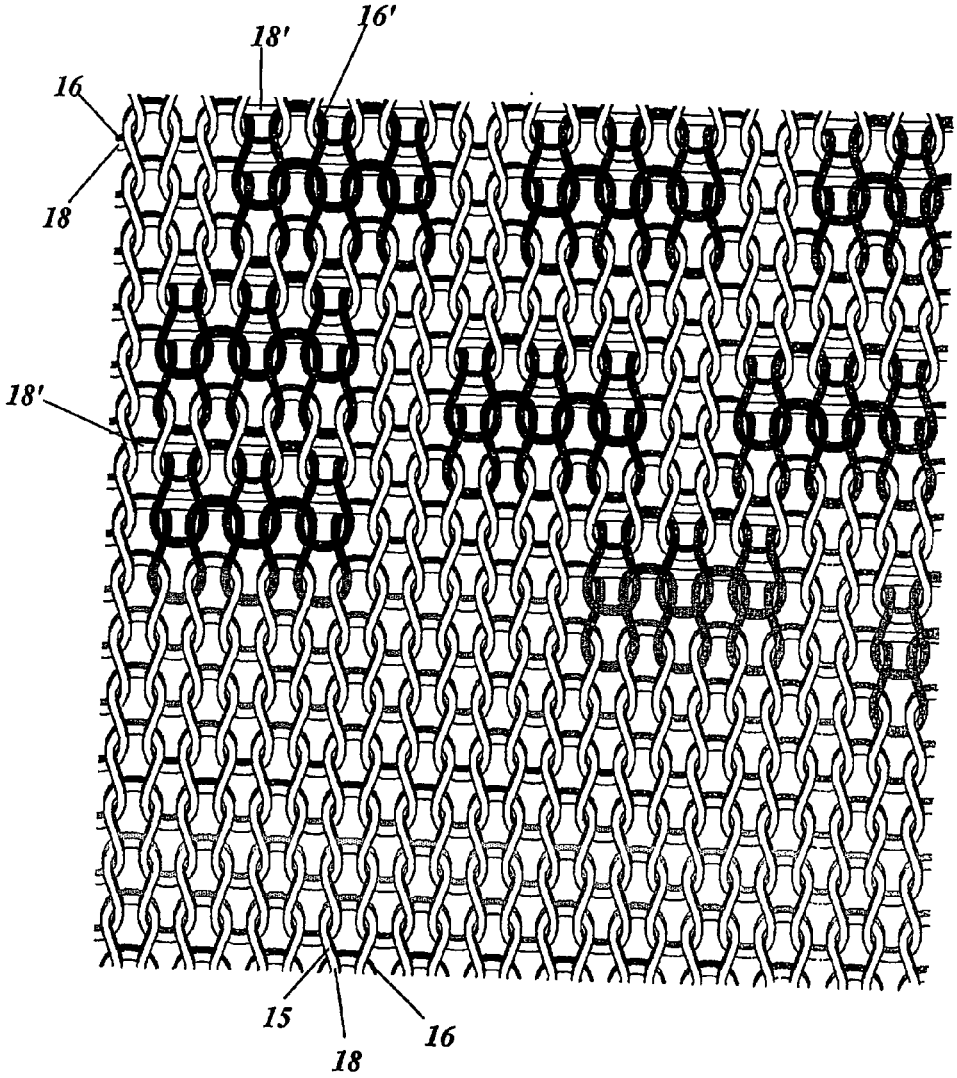
FIG. 2 is a stitch diagram showing a knitted stitch structure as used in the fabric shown in FIG. 1.
Figure 3:
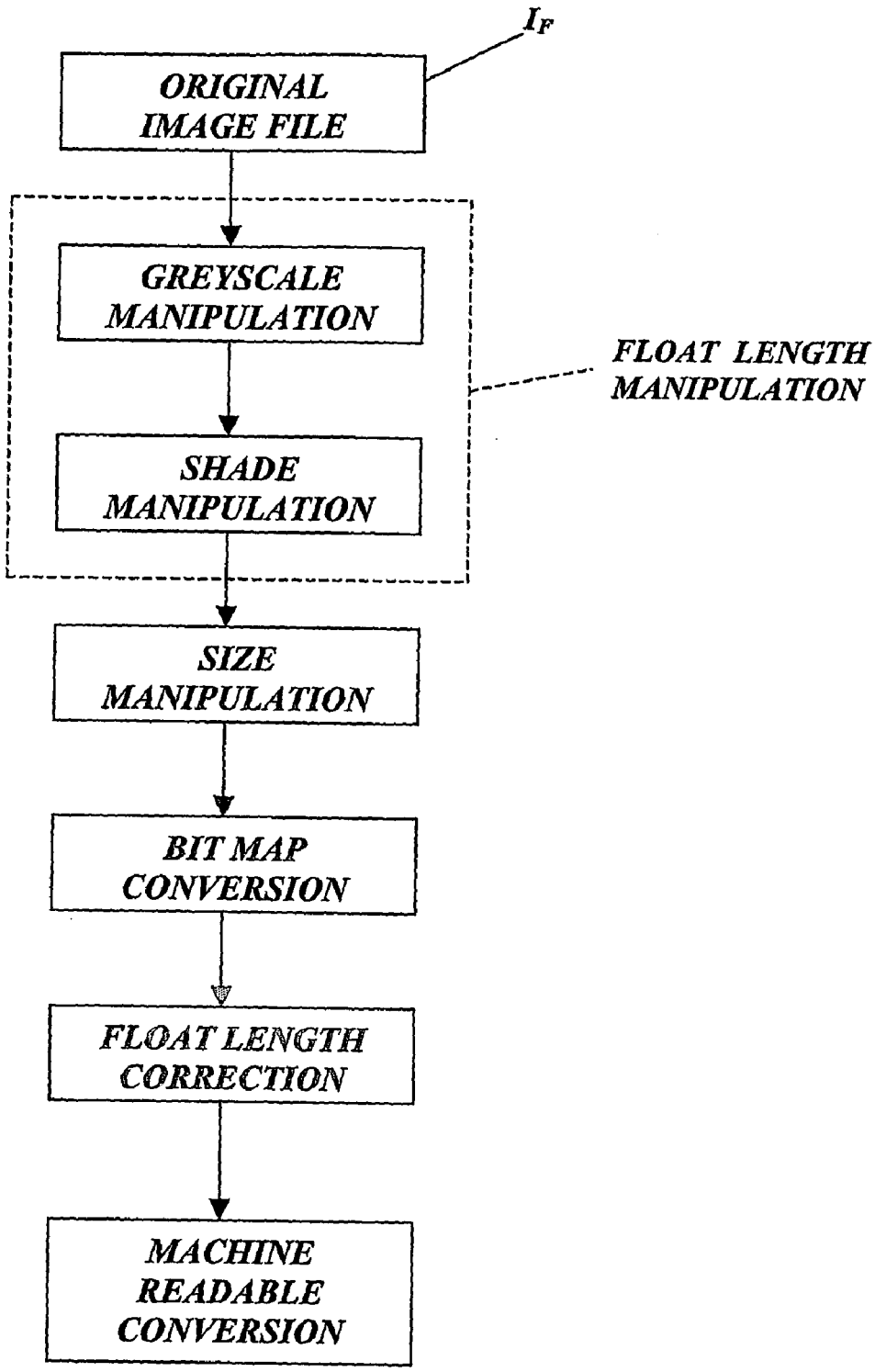
FIG. 3 is a block diagram schematically illustrating the process stages according to the preferred embodiment of the invention.

In FIG. 2, yarn 16 is illustrated as a light yarn and yarn 18 is illustrated as a dark yarn.

The pictorial image 12 is pixellated, i.e. it is composed of individual pixels each of which is defined by an individual knitted stitch.

Accordingly, in order to produce knitted fabric having the pixellated pictorial image 12, it is necessary to use a knitting machine having a programmable patterning means which may be programmed to cause the knitting machine to knit individual stitches of said light and dark yarn at selected locations and thereby produce the predefined pictorial image 12.

Preferably the patterning means is computer controlled. A suitable circular knitting machine is a Santoni SM8 (sold by Santoni S.p.A.) which has computer controlled patterning means.

As illustrated in FIG. 2, the knitted structure is preferably produced by plating the light and dark yarns using separate yarn feeders so that for needles knitting both yarns together, a plated stitch 15 is produced in which one of the yarns (the light yarn 18 in FIG. 2) is always located on the technical face of the fabric to mask the dark yarn 16 from view. Accordingly, an individual plated stitch 15 defines a light pixel for the image 12. In this specification yarn 18 is referred to as the 'masking' or 'second' yarn and the masked yarn 16 is referred to as the 'patterning' or 'first' yarn.

To create the pixellated image 12, selected needles are controlled to miss-knit the masking yarn 18 but to knit the patterning yarn 16. This has the effect of causing the masking yarn 18 to produce a float loop 18' which extends across the technical back of the fabric and so reveal the knitted stitch 16' produced from the patterning yarn 16.

In FIG. 2 it is stitch 16' which defines a dark coloured pixel for the image 12. On a given knitted course a plurality of adjacent needles may be selected to miss-knit the masking yarn 18 and thereby create a plurality of course-wise adjacent stitches 16'. The masking yarn 18 will form a float loop extending across the back of these adjacent stitches and so the greater the number of course-wise adjacent stitches 16', the longer the float loop 18'.

In order to reduce the likelihood of snagging and thereby enable the fabric to be used without a protective covering layer, it is preferred that the length of all the float stitches 18' in the image 12 are restricted to a predetermined maximum length. The predetermined maximum length will vary depending upon the type of yarn used as the masking yarn 18. For example a yarn which is prone to contract after knitting, such as a textured yarn, can have a greater predetermined maximum length than a yarn which is less prone to contraction after knitting.

It is preferred that the maximum predetermined length for the float stitches 18' is limited to an extent equivalent to 6 or less adjacent course-wise stitches of the first yarn, more preferably 3 or less.

In the wale-wise direction it is envisaged that any number of wale-wise adjacent stitches 16' may be produced.

It will be appreciated that a plated stitch 15 defines a single light coloured pixel for image 12 if it is immediately bound on either side in both the wale-wise and course-wise directions by a stitch 16'.

Within the area of fabric in which the pictorial image 12 is formed, the number of adjacent stitches 15 in both the course-wise and wale-wise directions is unrestricted since both the first and second yarns 16, 18 are knitted together to form plated stitches and so do not produce floats.

Preferably, in accordance with an embodiment of the invention, the size of the stitches is chosen such that the density and distribution of individual light and dark coloured pixels (formed by individual stitches 15 and 16') can be arranged to create an image 12 composed of discrete lines and/or different degrees of shading.

In a preferred embodiment according to the present invention, the knitted article is knitted on a fine gauge knitting machine.

In order to knit image 12, it is necessary to create a predefined set of instructions for programming the programmable patterning means of the knitting machine.

In the present example described below, it is assumed that the patterning means is controlled by a patterning computer associated with the knitting machine and that the set of instructions is in the form of stored electronic data, e.g. a program file, from which the patterning computer can be programmed to execute a pattern defined in the program file.

A preferred process according to the present invention for creating a program file is described below with reference to FIGS. 3 to 9.

In accordance with a preferred embodiment of the invention, the process is performed on a personal computer using a conventional image handling software program such as Adobe Photoshop®.

The first stage in the process is to create, from a suitable source, an image file $I_F$ in which an original of the image to be recreated as a knitted pictorial image 12 is stored in digital format.

Figure 4:
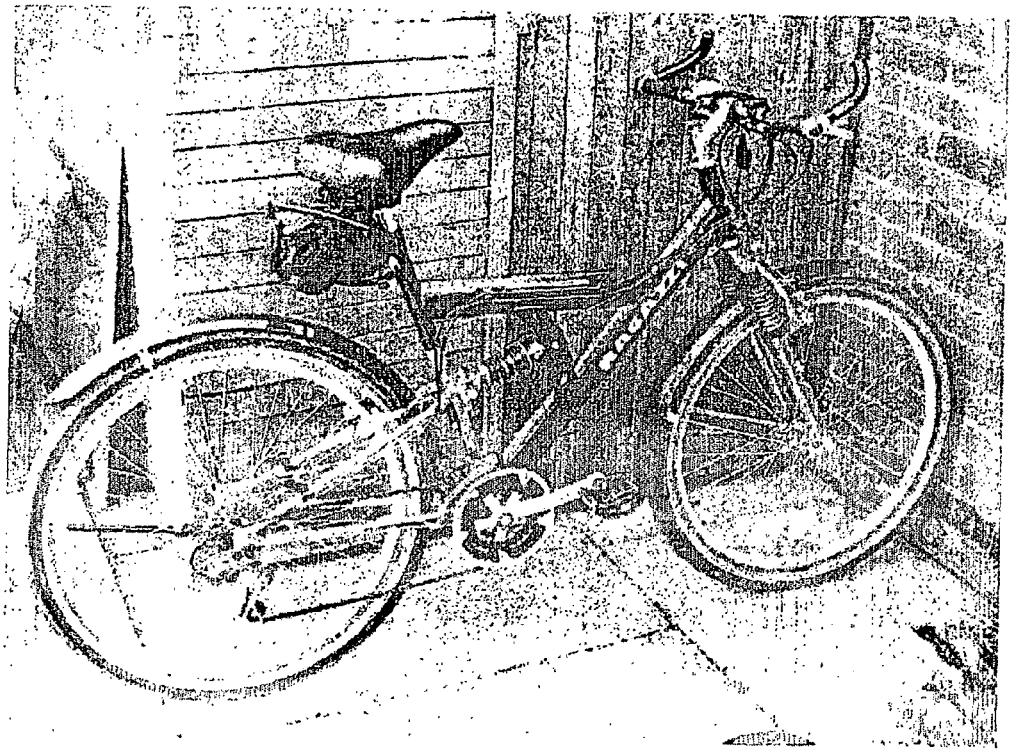
FIG. 4 shows the print out of a digital photograph which is to be reproduced on a fabric pattern in accordance with the preferred embodiment of the invention.

In FIG. 4 the original image is sourced from a digital photograph showing a bicycle. The photograph may be downloaded from a digital camera or may be scanned-in using a conventional scanner in order to create the image file $I_F$.

As indicated above, when creating image 12 as a knitted structure, float loops 18' have to be restricted to a maximum float stitch length which in the example being now described is assumed to be restricted to 3 course-wise adjacent stitches 16'. This in effect means that those areas in the original image which are to be defined by stitches 16' of the patterning yarn 16 have to be restricted to a maximum of 3 course-wise adjacent stitches.

In FIGS. 3 to 9 the masking yarn 18 is assumed to be a light yarn and the patterning yarn 16 is assumed to be a dark yarn.

The second stage of the process is to manipulate the digitised image stored in image file $I_F$ into a 'float corrected' digitised image in which the majority, if not all, image areas requiring more than 3 adjacent course-wise stitches 16' are modified so that the entire image may be recreated by knitting without any area exceeding 3 adjacent course-wise stitches 16'.

If the original digitised image is in colour, it is first necessary to convert the image into a grey scale. Conversion into a grey scale image enables the image to be recreated using two contrasting colours and produces an image composed of areas of varying degrees of shading as exemplified in FIG. 4.

In the example of FIG. 4, the darkermost areas are to be knitted using a highest density of stitches 16', the lightermost areas are to be knitted using stitches 15 alone and the areas having a darkness value between the darkermost and lightermost areas are to be knitted using a desired distribution and density of stitches 16' and 15.

The second stage of the process involves analysing the image shown in FIG. 4 to identify the darkermost areas in the image. If, in the image there are relatively large areas of solid darkness it is to be expected that these areas will require more than 3 course-wise adjacent stitches 16' when knitting. As mentioned above, such areas cannot be reproduced without creating undesirably long float loops 18'.

In order to restrict the maximum float loop length to 3 or less adjacent stitches in any course throughout the image 12, the dark areas in the digital photograph are analysed to determine the darkermost area in the photograph. The darkness value of the darkermost area is then changed so that it is the same as or less than a desired maximum value and all other areas within the photograph are also changed in order to maintain the clarity, i.e. visual definition, of the image.

The purpose of changing the darkermost areas to a desired darkness maximum value is to achieve a maximum darkness throughout the image which can be recreated from a mixed distribution and density of stitches 16' and 15 wherein the maximum number of adjacent course-wise stitches 16' is 3 or less.

Analysis of the darkness value of the image is achieved in the Adobe PhotoShop software by identifying the greyness value of the darker areas in the image to find the darkermost area.

In the Adobe PhotoShop software, this is achieved by selecting an area of the image and then selecting the 'Colour Picker' command. This provides an analysis of the greyness value by reference to its Red, Green and Blue values. Preferably the desired maximum darkness value is defined by the Red, Green and Blue values being of the same value; in the present example this value is preferably about 100.

At this value for the Red, Green and Blue values, a level of darkness is achieved which can be reproduced from a knitted structure in which the maximum number of adjacent course-wise stitches 16' is 3 or less.

Figure 5A:
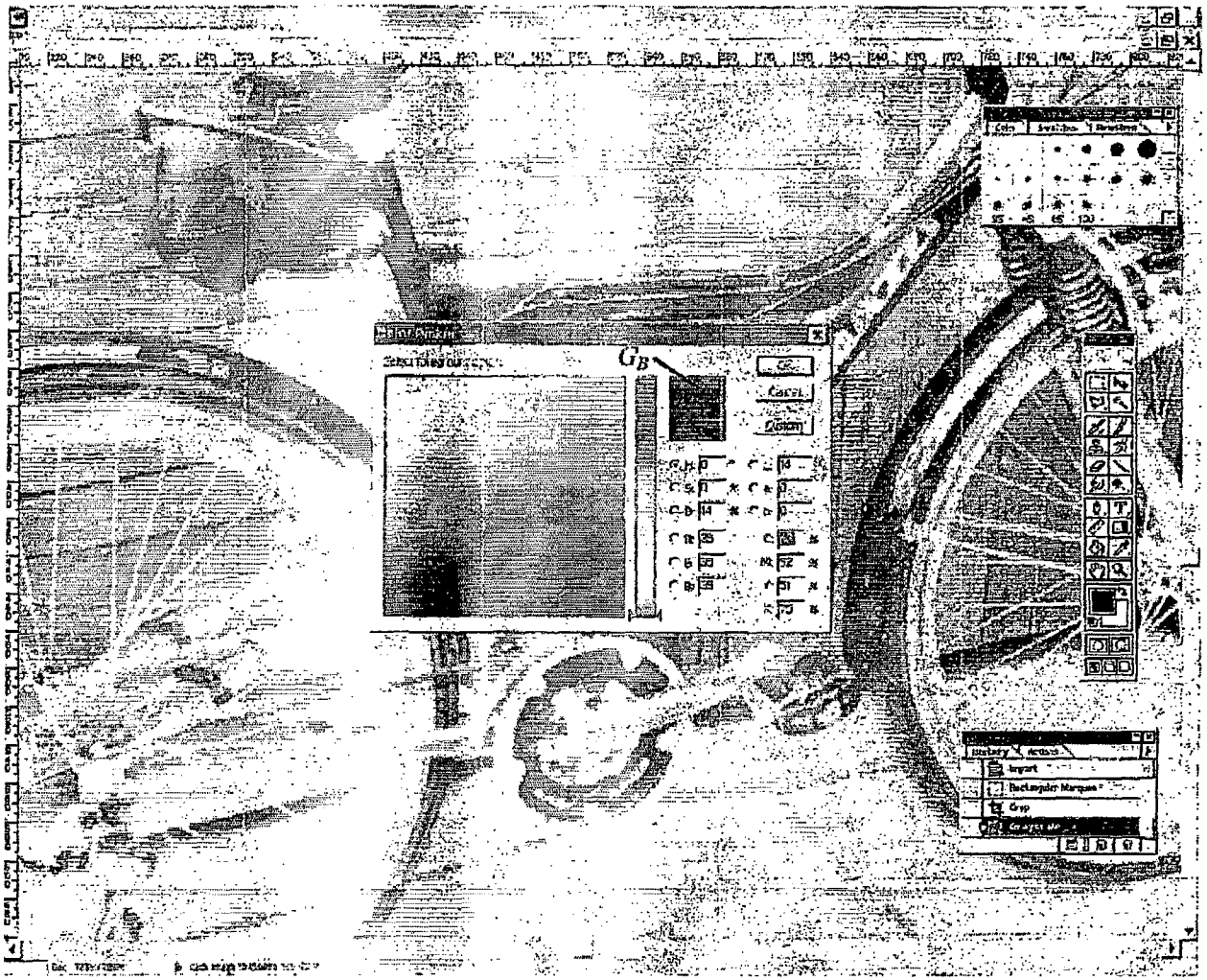
FIGS. 5*a*, 5*b* are visual reproductions of a PC monitor screen illustrating a first stage in the process according to the preferred embodiment of the invention.

This is illustrated with reference to FIGS. 5*a* and 5*b* in which the original photographic image in the image file $I_F$ is shown before manipulation to change the darkness values. A dark area has been selected and the 'Colour Picker' window has been opened to show that the selected area has a darkness value expressed as 35 Red; 35 Green and 35 Blue. The depth of darkness of the selected area can be seen in the box $G_B$ in the 'Colour Picker' window and appears solid black. This area would be too dark and would require in excess of 3 adjacent course-wise stitches 16' to be reproduced.

Figure 5B:
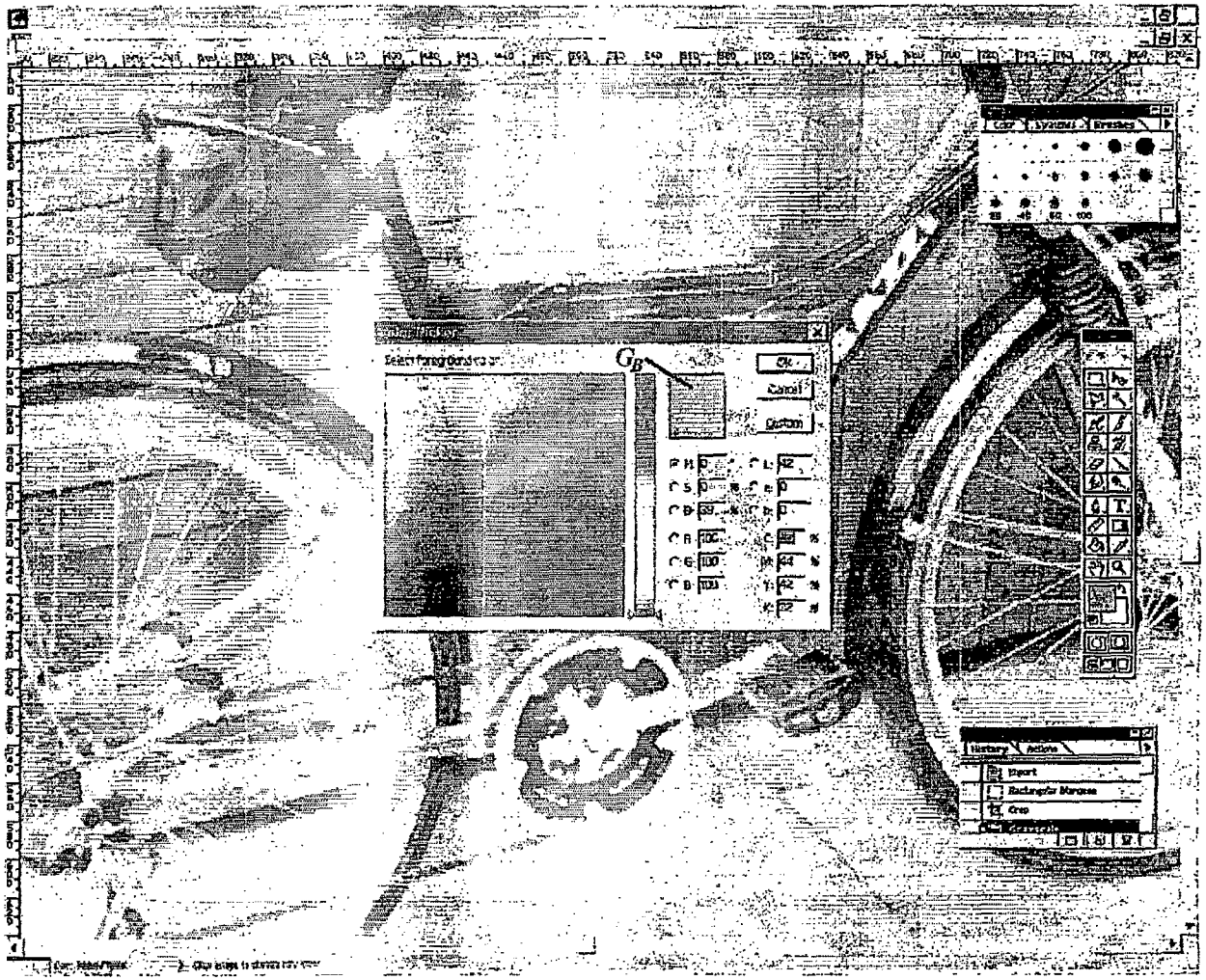

In FIG. 5*b*, another area has been selected and the Red, Green and Blue values are shown as 100 Red, 100 Green, 100 Blue. It will be seen that the depth of darkness seen in box $G_B$ has changed to a lighter darkness. This lighter dark area is of a darkness value which could be reproduced with no more than 3 adjacent course-wise stitches.

In order to lighten the darkermost areas identified by the 'Colour Picker' operation to a darkness value of about 100 Red, 100 Green, 100 Blue, it is preferable to manipulate the photographic image using the 'Curves' command.

Figure 6A:
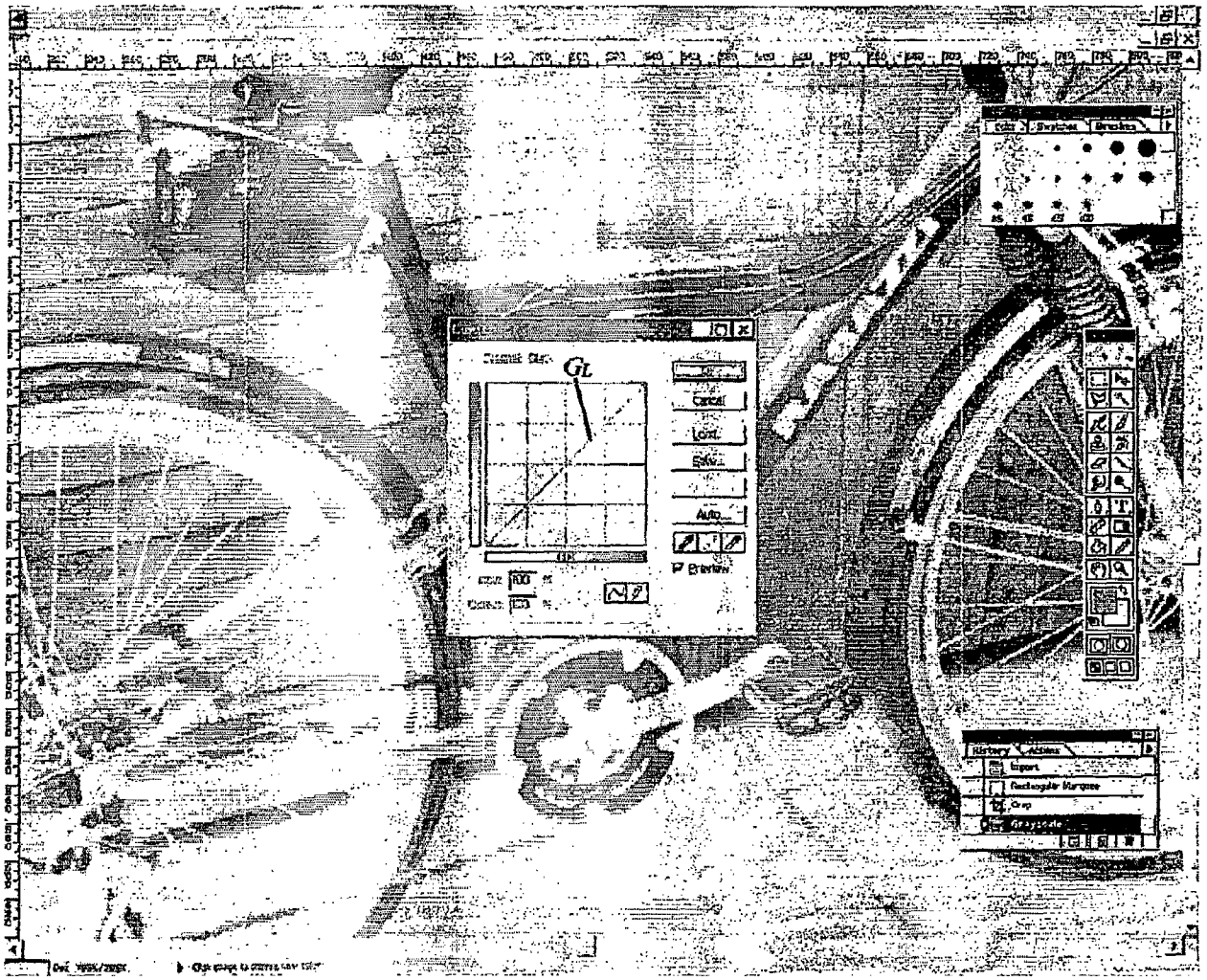
FIGS. 6*a*, 6*b* are visual reproductions of a PC monitor screen illustrating a second stage in the process according to the preferred embodiment of the invention.
Figure 6B:
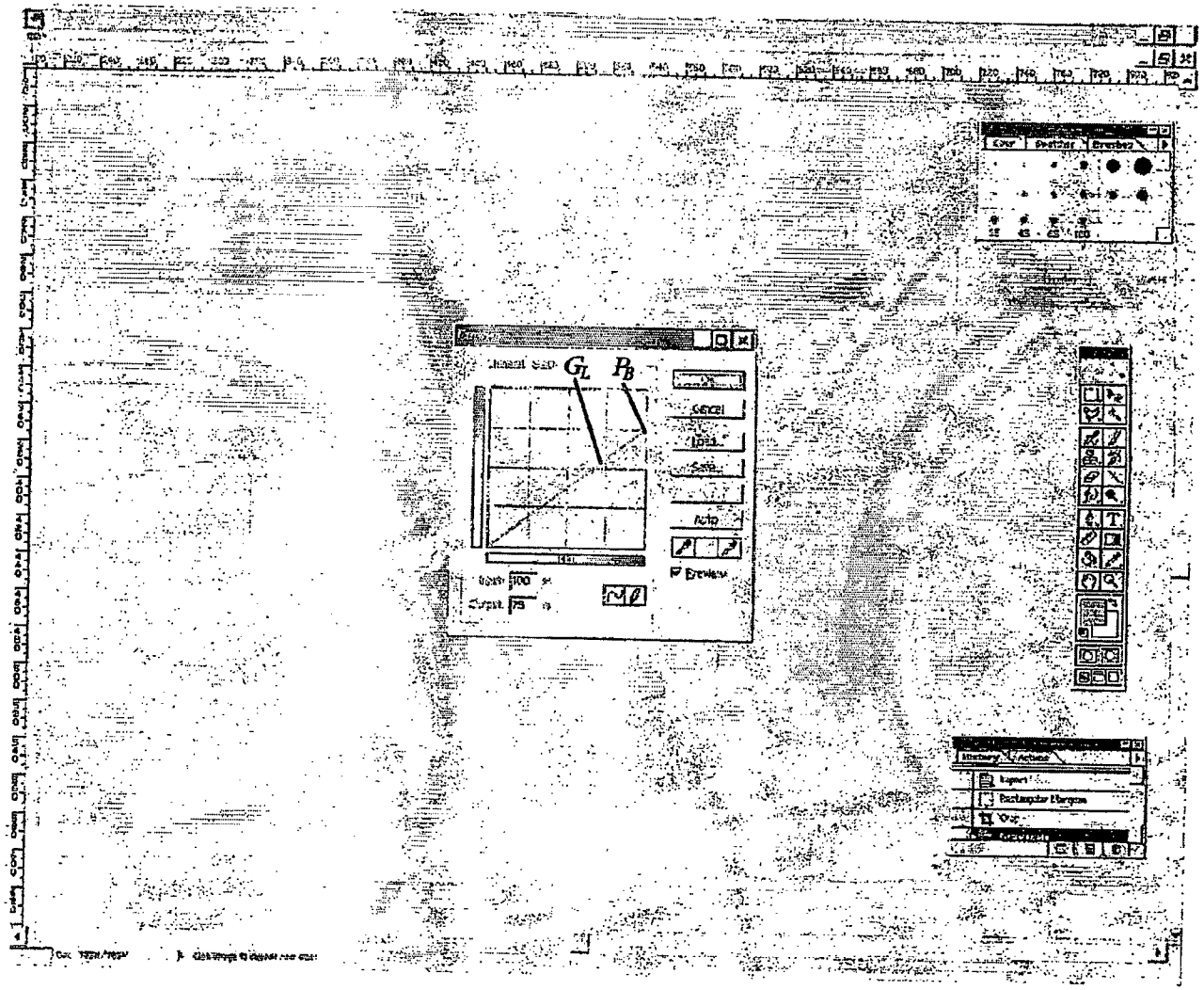

An example of manipulating using the 'Curves' command in Adobe Photoshop to reduce the maximum darkness value of the darkermost areas within the image to a desired maximum value is shown in FIGS. 6*a*, 6*b*. In FIG. 6*a*, the 'Curves' window graphically shows the rate of change from black to white by a gradient line $G_L$. As illustrated, the y axis represents the change from white to black of the original "input" image and the x axis shows the rate of change from white to black of the "output" image shown on screen. The gradient line $G_L$ in FIG. 6*a* is a straight line which indicates that there is a constant change from white to black throughout both the input and output images i.e. any point along the gradient line $G_L$ has the same x and y value: this indicates that in both images the change from white to black is throughout the same range of 'grey' values. This is represented by an input value of 100% and an output value of 100%.

In order to reduce the darkness value of the darkermost areas within the image (and thereby limit length of float loops 18' to a maximum of 3 stitches 16') it is necessary to reduce the darkermost output value. This is illustrated in FIG. 6*b* wherein the graphic point $P_B$ representing the black value on the input image has been moved downwards on the y axis to an output value of 75%. As a consequence the manipulated image shown in FIG. 6*b* is considerably lighter than the image shown in FIG. 6*a* but is distinct in that the image is clearly defined.

Since the graphic line $G_L$ is linear, all darkness values in the output image (FIG. 6*b*) will be 75% of the darkness value of the corresponding areas in the original image (FIG. 6*a*). As is well known in the use of a 'Curves' command, the graphic line $G_L$ may be manipulated into a curve so as to vary, in the output image, the relative darkness values of all the remaining areas having a darkness value between the maximum set value and the minimum set value. This can be useful for improving the image definition for the output image.

Once the image has been manipulated using the 'Curves' command, it may then be analysed again using the 'Colour Picker' command to check the darkness value of the darkermost areas. If this value is still too high, further manipulation to reduce the darkness value using the 'Curves' command may be performed.

The process of analysing the darkness value of the darkermost areas using the 'Colour Picker' command and then adjusting the darkness values of the darkermost area using the 'Curves' command may be repeated several times if necessary to ensure that the darkermost area within the photographic image is reduced to a maximum darkness value.

Once this has been achieved, the manipulated image is saved as a float modified image file and this completes the second stage of the process.

The third stage of the process involves manipulating the float modified image in order to change its height and width dimensions so that, after knitting, the image the image 12 is reproduced in height and width proportions similar to those of the original image.

In this respect, it is recognised that when knitted fabric comes off the knitting machine there are different degrees of contraction in the wale-wise direction and course-wise directions; the relative amounts depending upon the type of knitted structure and/or type of yarns used.

In the present example, plain plated stitches and float stitches are being produced in order to create the desired knitted image. It is expected therefore that the fabric when coming off the knitting machine will shrink in the wale-wise direction by a greater proportion than in the course-wise direction.

Accordingly in order for the knitted image to accurately reproduce the height and width proportions of the original image, it is desirable to stretch the height dimension of the float corrected image relative to its width dimension so as to compensate for the greater amount of wale-wise shrinkage of the fabric as it comes off the knitting machine.

Typically, the proportion of stretch is such as to achieve a height to width ratio of about (1.5 to 2):1.

The float modified image is therefore re-sized on the computer by increasing its height to width ratio within the range (1.5 to 2):1 and the float/size modified image is then saved.

The fourth or next stage in the process is to convert the float/size corrected digitised image from the second and third stages into a form which will enable a knitting machine to knit the image. This is done by converting the image into a bit-map image in which the bits represent pixels for the knitted image. The pixels in turn represent individual stitches.

This is achieved in Adobe Photoshop by selecting the 'Bitmap' command and selecting a mid-grey value. Consequently all pixels either side of the mid-grey value become either black or white.

After selecting the bitmap command, it is necessary to choose either a 'diffusion' or 'regular' pattern. The effect of choosing these patterns is illustrated in FIGS. 7 and 8 respectively.

Which of these patterns is selected for use depends upon the nature of the image. For instance, for images of a geometrical nature having sharp lines and blocks of colour, the regular pattern may be more suitable for use than the diffusion pattern. For images containing large areas of shading, the diffusion pattern is generally more suitable.

Figure 8:
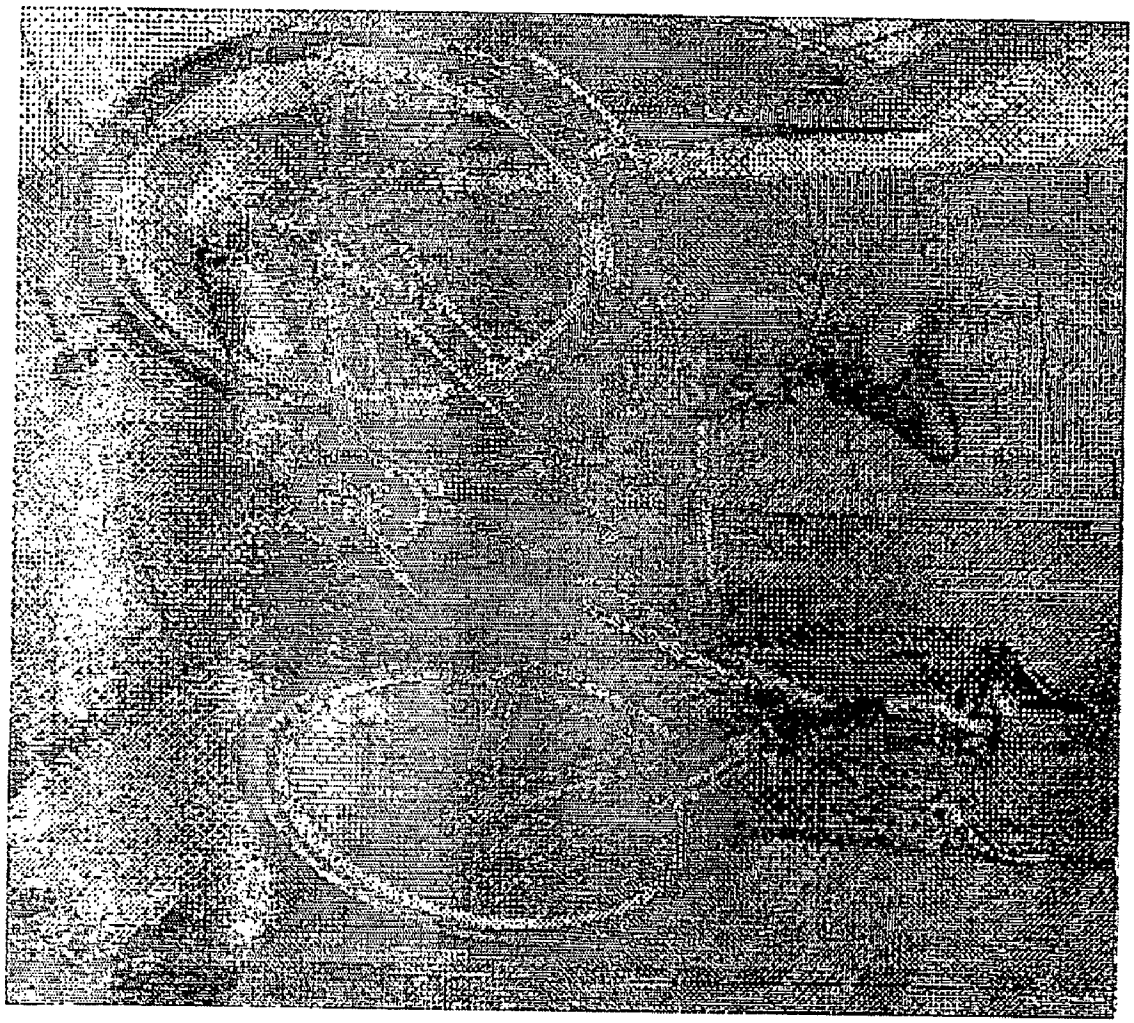
FIG. 8 is a visual representation similar to FIG. 7 showing, for comparison purposes, an alternative variant to the fourth process stage.

For example, as shown in FIG. 8, if a 'regular' pattern is selected for the bicycle image of the present example, large solid areas of dark colour may be introduced into the image and the definition may be lost. For the present example therefore this option is not chosen as it would reintroduce the creation of float loops in excess of 3 adjacent course-wise stitches and a loss of definition.

Figure 7:
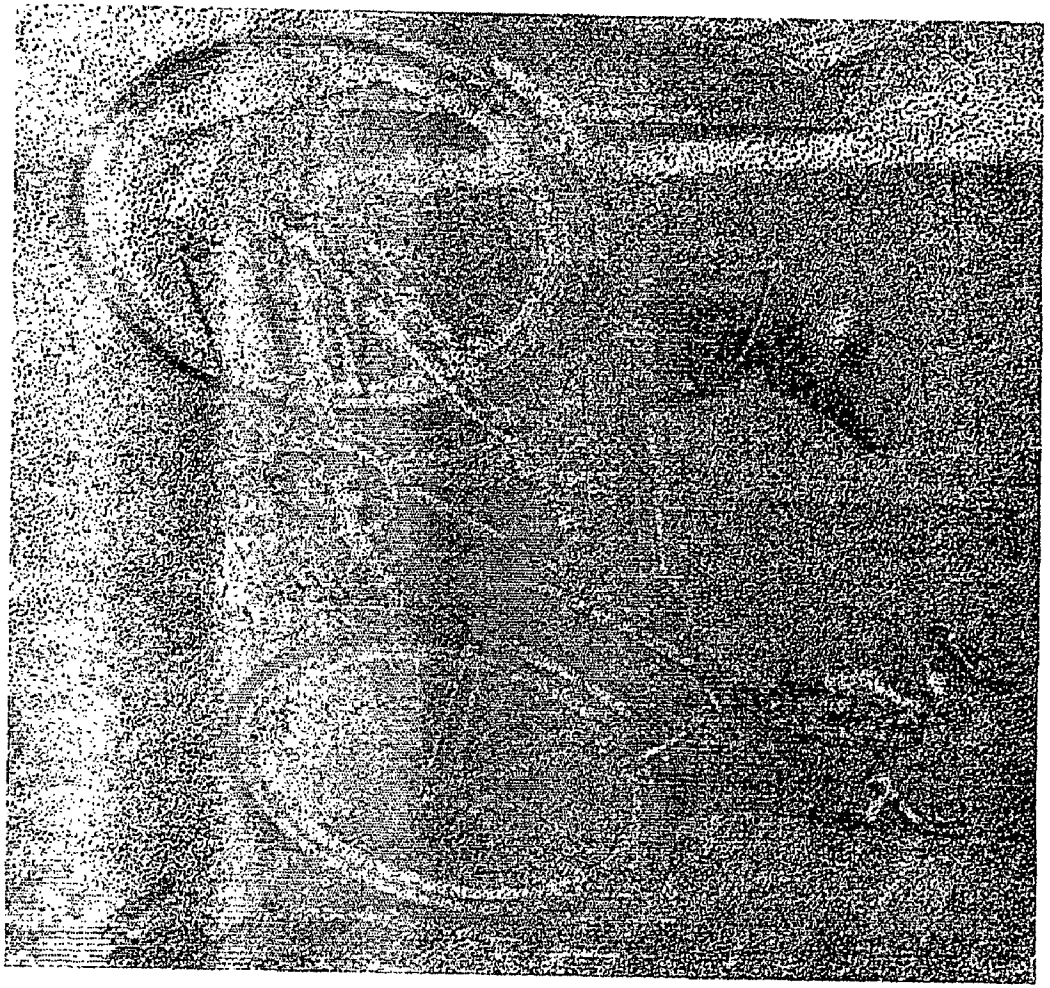
FIG. 7 is a visual representation of a PC monitor screen illustrating third and fourth stages in the process according to the preferred embodiment of the invention.

By contrast, as shown in FIG. 7, if the 'diffuser' pattern is selected, the pixel pattern is randomly generated creating no excessively large dark areas and a clearer definition of the image. Accordingly, for the present example, a diffused bitmap image is created.

The diffused bitmap image shown in FIG. 7 is also illustrated after stretching of the image has taken place.

Once the diffused bitmap image has been created it is analysed to locate any areas where there are more than 3 adjacent horizontal dark bits, each dark bit corresponding to a knitted stitch of the first yarn. This is the fifth and final stage for limiting the maximum float length to 3 or less adjacent course-wise stitches 16' throughout the image 12.

Figure 9A:
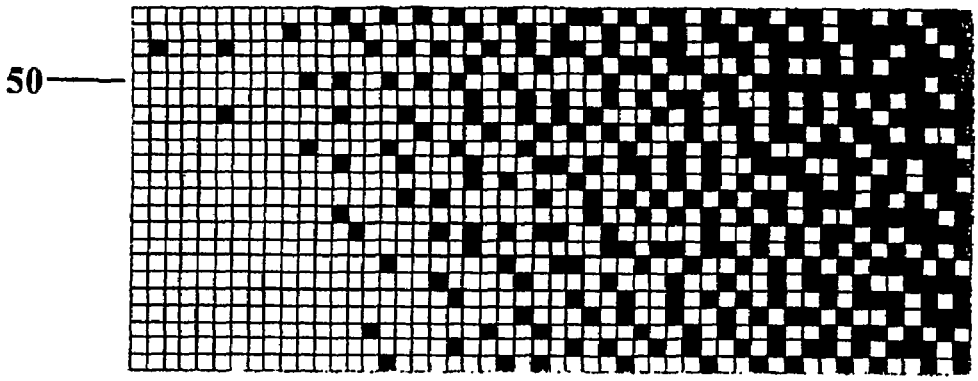
FIGS. 9*a*, 9*b* are, respectively, diagrammatic representations of bit maps prior to and subsequent to manipulation in accordance with a fifth stage of the preferred embodiment of the invention.
Figure 9B:
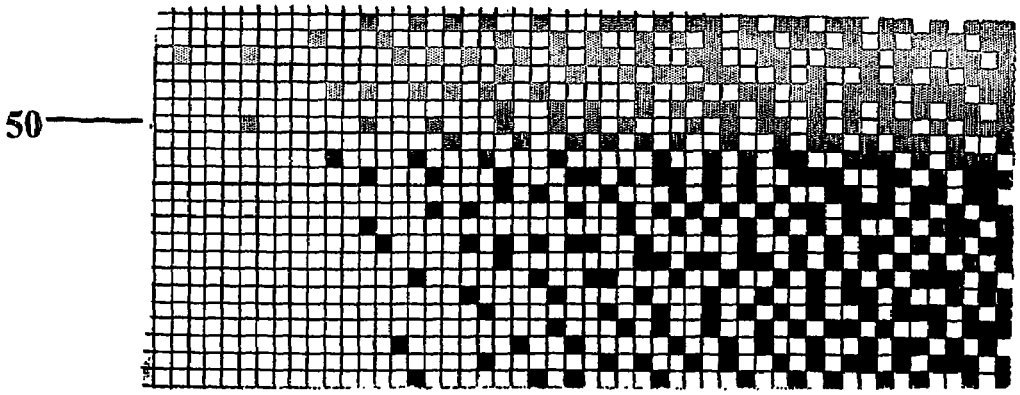

FIG. 9*a* illustrates a portion of the bitmap and shows horizontal rows 50, some of which include blocks of dark bits comprising more than 3 adjacent bits. The horizontal rows in FIGS. 5*a*, 5*b* correspond to courses to be knitted. In FIG. 9*b*, the bitmap has been modified such that the blocks of dark bits in rows 50 have been modified so that there is a maximum of 3 adjacent bits in each dark bit block. Preferably, the dark bits are removed from each block in a random manner to avoid removing dark bits at the same vertical position in blocks on adjacent rows so as to avoid the creation of a vertical 'white' line in the image 12.

This modified bitmap image is saved in desired file format to be exported to the knitting machine computer controlling the patterning means of the knitting machine on which the image is to be knitted.

In the above example, the masking yarn 18 and patterning yarn 16 are chosen to have contrasting colours in order to create the image 12. In the example, the first yarn 16 is a dark yarn and the second yarn 18 a light yarn. It will be appreciated that instead, first yarn 16 may be a light yarn and second yarn 18 may be a dark yarn. It is to be appreciated that yarns 16 and 18 may have different contrasting physical properties in order to create image 12, e.g. yarns 16 and 18 may have different dye take-up characteristics to enable selective dyeing to be performed.

Figure 10:
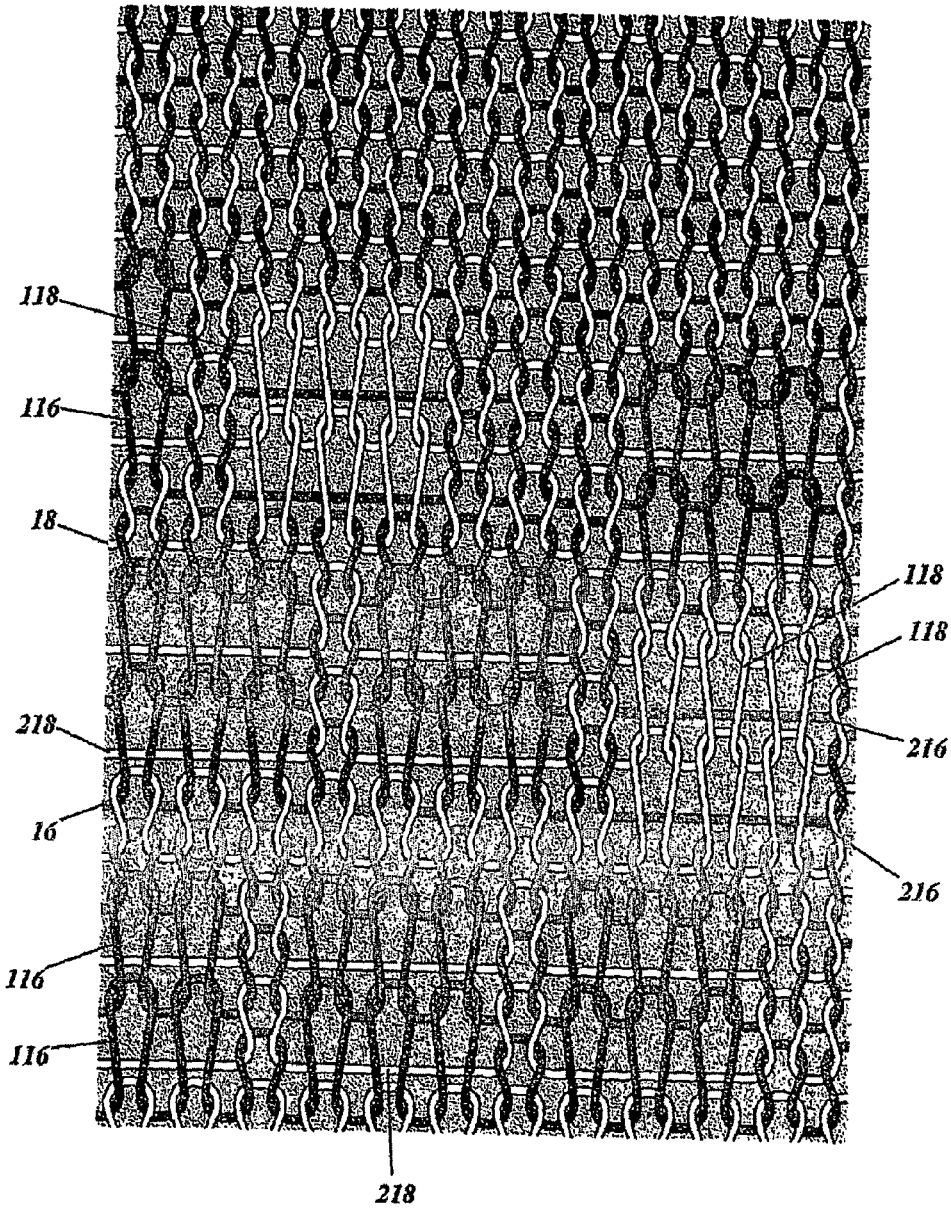
FIG. 10 is a stitch diagram showing an alternative knitted structure according to the present invention.

It will also be appreciated that different knitted structures may be adopted; for example an alternative knitted structure 100 for producing a pictorial image is exemplified in FIG. 10.

The knitted structure 100 is basically a miss-knit structure in which both yarns 16 and 18 are knitted on alternative courses. At selected positions along selected courses, yarn 16 produces a float stitch 216 which extends behind a coursewise group of adjacent plain stitches 118 knitted from yarn 18 and vice versa, i.e. yarn 18 produces a float stitch 218 which extends a coursewise group of adjacent plain stitches 116. The stitches 116, 118 extend across the intermediate course being knitted from the other yarn to define the pixels for recreating a desired pictorial image.

Each group of coursewise stitches 116, 118 may contain one or more stitches.

When adopting the knitted structure 100, it is necessary to modify the float correction procedure (the second stage described above) to take into account that both yarns 16, 18 will produce float loops.

Accordingly, the process is modified so as to identify those areas in the image which are to be reproduced by a majority of knitted stitches 116 and those areas in the image which are to be reproduced by a majority of knitted stitches 118.

Thus, when modifying the image in the second stage the darkermost areas are identified and lightened to be the same as or lighter than a predetermined dark value and the lightermost areas are identified and darkened to be the same as or darker than a predetermined light value. This ensures that prior to creation of the bit-map image, a float corrected image is produced for both yarns 16, 18.

On creation of the bit-map image, all rows of bits are analysed to identify, in a given row, the number of adjacent dark bits and the number of adjacent light bits. Where the number of adjacent dark or light bits exceeds a predetermined number, the relevant group of bits is edited so as to reduce the number of adjacent dark or light bits in that group so as not to exceed the desired predetermined number.

The invention claimed is:

1. A method for creating pattern instructions for an electronic patterning control of a knitting machine to enable the knitting machine to knit fabric having a desired pictorial image as part of the knitted structure, the method comprising:

(i) creating an original scale digital image having dark areas representative of those areas to be recreated by knitted stitches of a first yarn and light areas representative of those areas to be recreated by knitted stitches of a second yarn;

(ii) analysing the original scale digital image to determine a darkness value of a darkest area of the original scale digital image;

(iii) changing the darkness value of the darkest area to a first revised darkness value that is the same as or less than a first predetermined darkness value and changing a remaining area darkness value of some or all remaining areas to maintain visual definition of the original scale digital image and to create, with respect to the second yarn, a floating modified image;

(iv) creating a bit map image from the float modified image, the bit map image having dark bits and light bits arranged in horizontal rows corresponding to a series of consecutive courses to be knitted and vertical columns corresponding to wales to be knitted, each dark bit corresponding to a knitted stitch of the first yarn and each light bit corresponding to a knitted stitch of the second yarn; and (v) analysing and modifying the bit map image to create a modified image in which a number of adjacent dark bits in each horizontal row do not exceed a predetermined number.

2. A method according to claim 1, further comprising creating electronic pattern instructions by converting the modified image into electronic instructions readable by said electronic patterning control.

3. A method according to claim 1, wherein the original scale digital image is created by converting a colour image to grey scale.

4. A method according to claim 1, wherein the original scale digital image is a photographic image.

5. A method according to claim 1, wherein said predetermined number is 6 or less.

6. A method according to claim 5, wherein said predetermined number is 3.

7. A method according to claim 1, wherein the desired pictorial image is created by knitting the first yarn to produce float loops spanning those knitted stitches of the second yarn that separate adjacent knitted stitches of the second yarn, the method further comprising:

analysing the original scale digital image to determine the darkness value of a lightest area and changing the darkness value of the lightest area to a second revised darkness value that is the same as or greater than a second predetermined darkness value to thereby create the floating modified image, and analysing and modifying the bit map image so that a number of adjacent light bits in each horizontal row do not exceed said predetermined number.

8. A knitted fabric comprising:

a pictorial image on one face, the pictorial image having a series of consecutive courses each of which comprises knitted stitches formed of a first yarn having a first visual characteristic interspersed with knitted stitches formed of a second yarn having a second visual characteristic, and adjacent knitted stitches of the second yarn which are separated by one or more knitted stitches of the first yarn being connected by a float loop spanning said one or more knitted stitches of the first yarn, the knitted stitches of the second yarn being formed by plating the first and second yarns together to produce knitted stitches with the second yarn being located on the one face of the fabric in order to mask the first yarn.

9. A knitted fabric according to claim 8, wherein the number of adjacent knitted stitches of the first yarn located between each adjacent pair of knitted stitches of the second yarn is between 1 to 6 adjacent stitches throughout the pictorial image.

10. A knitted fabric according to claim 8, wherein the first yarn has a different visual appearance to the second yarn.

11. A knitted fabric according to claim 8, wherein the first and second yarns have different dye take-up characteristics.

12. A method for creating pattern instructions for an electronic patterning control of a knitting machine to enable the knitting machine to knit fabric having a desired pictorial image as part of the knitted structure, comprising:

creating an image file for storing a knitted pictorial image of an original image;

manipulating the image file into a float corrected image;

changing a height and a width dimension of the float corrected image to produce a float/size corrected image to reproduce a height and width of the original image;

converting the float/size corrected image into a bit-map image; and limiting to 3 or less a maximum float length for adjacent course-wise stitches throughout the bit-map image.

13. The method according to claim 12, wherein the pictorial image is stored in digital format.

* * * * *